US006293833B1

(12) United States Patent
Kamath

(10) Patent No.: US 6,293,833 B1
(45) Date of Patent: Sep. 25, 2001

(54) LOW INSERTION FORCE, HIGH CONTACT FORCE TERMINAL SPRING

(75) Inventor: Shashidhar M. Kamath, Belleville, MI (US)

(73) Assignee: Yazaki North America

( * ) Notice: Subject to any disclaimer, the term of this patent is extended or adjusted under 35 U.S.C. 154(b) by 0 days.

(21) Appl. No.: 09/755,477

(22) Filed: Jan. 5, 2001

(51) Int. Cl.[7] ..... H01R 11/22
(52) U.S. Cl. ..... 439/851; 439/839; 439/852
(58) Field of Search ..... 439/842, 843, 439/851, 852, 862, 839, 849, 850, 845

(56) References Cited

U.S. PATENT DOCUMENTS

| | | | | |
|---|---|---|---|---|
| 4,607,907 | | 8/1986 | Boqursky . | |
| 4,696,530 | | 9/1987 | Vandame . | |
| 4,699,444 | * | 10/1987 | Isohata | 43/852 |
| 4,795,379 | | 1/1989 | Sasaki et al. . | |
| 5,083,936 | | 1/1992 | Yang . | |
| 5,350,321 | * | 9/1994 | Takenouchi | 439/851 |
| 5,540,603 | * | 7/1996 | Fujiwara | 439/851 |
| 5,601,458 | | 2/1997 | Ohsumi et al. . | |
| 5,722,925 | | 3/1998 | Kameyama et al. . | |
| 5,733,155 | * | 3/1998 | Sagawa | 439/852 |
| 5,941,740 | * | 8/1999 | Neuer et al. | 439/852 |
| 6,062,918 | * | 5/2000 | Myer et al. | 439/843 |
| 6,079,988 | | 6/2000 | Hashiguchi et al. . | |
| 6,152,788 | | 11/2000 | Hata et al. . | |
| 6,206,738 | | 3/2001 | Sugie . | |

FOREIGN PATENT DOCUMENTS

| | | |
|---|---|---|
| 3-126370 | 12/1991 | (JP) . |
| 03205555 | 2/1993 | (JP) . |
| 04004236 | 7/1993 | (JP) . |
| 7-45322 | 2/1995 | (JP) . |

* cited by examiner

*Primary Examiner*—Tho D. Ta
(74) *Attorney, Agent, or Firm*—Young &Basile

(57) ABSTRACT

A female spring contact for a female wire harness terminal of the type used in automotive wire harness connectors. The female spring contact has a deflectable spring ramp adapted to be deflected downwardly under an initial insertion force by an inserted male terminal. The female spring contact includes a secondary spring arm formed from a cantilevered portion of the ramp and located below the spring ramp to be responsive to a final stage of spring ramp deflection corresponding to the completion or near-completion of male terminal insertion to increase the final spring force exerted by the spring ramp on the inserted terminal. The initial insertion force required by the inserted terminal remains unaffected by the secondary spring arm, and in one embodiment is actually reduced by the structure of the secondary spring arm. In another embodiment the secondary spring arm is adapted to be forced upwardly through an aperture in the spring ramp to provide an additional electrical contact against the inserted terminal near the end of terminal insertion.

10 Claims, 5 Drawing Sheets

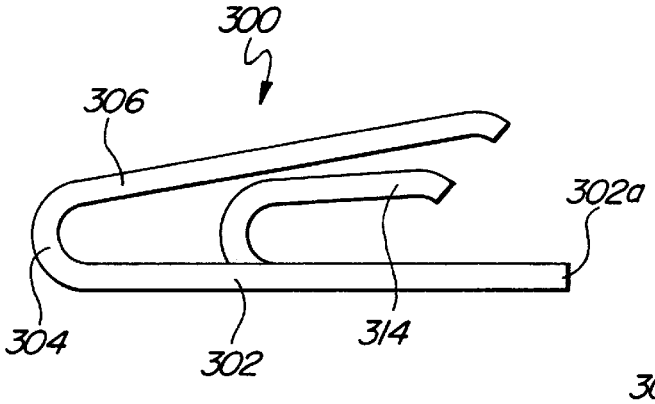
FIG-5A
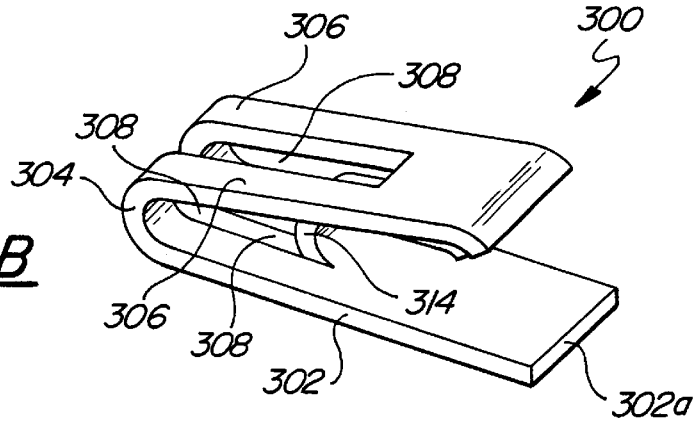
FIG-5B
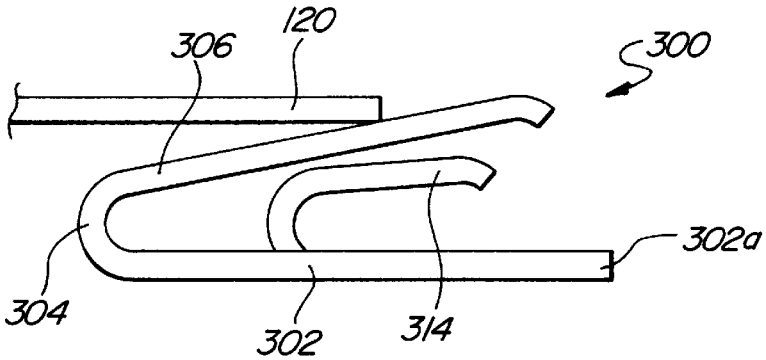
FIG-5C
FIG-5D
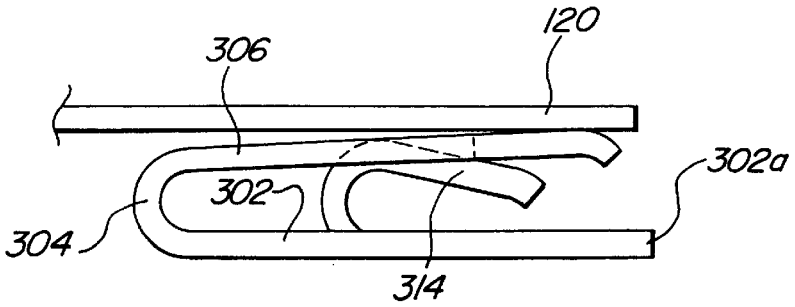

LOW INSERTION FORCE, HIGH CONTACT FORCE TERMINAL SPRING

FIELD OF THE INVENTION

The present invention is in the field of electrical terminal contact springs, in particular those used in wire harness connectors of the automotive type.

BACKGROUND OF THE INVENTION

Wire harnesses are frequently used in the automotive industry to make electrical connections between various vehicle components, power sources, and systems. Female wire harness terminals in these types of connectors typically take the form of a cantilevered spring contact set at an angle to form a deflectable ramp inside an at least partially enclosed terminal chamber. As a male terminal is inserted in the female chamber, it wipes against and displaces the female ramp contact under spring tension such that, when fully inserted, the spring tension of the female contact establishes a secure electrical connection between the terminals.

It is desirable to form the female spring contact with a strong spring force so as to maintain a good electrical connection despite the vibration normally encountered by wire harness connections in vehicles.

Because the space inside the female terminal chamber is limited, and because the depth of insertion of the male terminal into the female terminal is limited, the space in which the female spring contact can be designed to produce an effective spring force against the inserted male contact is limited. In an effort to improve the spring force of a simple cantilevered spring contact, the prior art (see FIGS. 1 and 2) has typically relied on an independent, secondary spring element 1,1' located in the female terminal chamber 2,2' to engage a portion of the female spring contact 3,3' and increase the force with which it yields upon insertion of the male contact in the direction of the arrow.

These secondary spring elements, however, tend to be difficult to manufacture and install to tight tolerances, and tend to increase the length of the female terminal chamber, neither of which is desirable. Additionally, the insertion force for the male contact is significantly increased.

SUMMARY OF THE INVENTION

The present invention is a cantilevered female spring contact for a wire harness terminal chamber in which the female spring contact is formed from a single piece of metal to include both primary and secondary spring elements. The secondary spring element is placed so as to be activated only at or near full insertion of a male contact in the female terminal chamber. Further, the secondary spring contact is located below the primary female spring contact, and is shorter than the primary spring contact, such that the contact as a whole requires no more space in the terminal chamber than would a simple, single-element cantilevered contact.

In a first embodiment, the cantilevered spring ramp against which the male terminal is inserted has secondary spring arms formed from its outer edges. The outer arms are bent downwardly below the plane of the ramp, and further are spaced above the base of the contact in the female contact's at-rest position, such that partway through the insertion of the male terminal (preferably at or near full insertion) the ramp is deflected sufficiently to lower the secondary spring arms into engagement with the contact base, thereby increasing the final spring force acting against the male terminal in the chamber. At the same time, the initial terminal insertion force is not increased.

In a second embodiment of the invention, an inner or middle portion of the ramp is cut free at a rearward end of the terminal and bent downwardly to form the secondary spring element. In a further preferred form of this second embodiment, the secondary spring element is bent generally in a V-shape with a rearward, raised portion which engages the underside of the ramp to increase the spring force when the lowermost portion of the V engages the contact base. In this second embodiment, the insertion force does not increase until a point at or near full terminal insertion, resulting in normal insertion force with a higher final retention force.

In a third embodiment of the invention, the ramp element is slotted down an interior portion, the slot extending through the spring radius of the ramp to reduce the initial insertion force. Additionally, material removed from the ramp, radius, and contact base to extend the slot around the spring radius is itself bent upwardly and rearwardly as a separate, cantilevered, secondary spring element whose free end is located underneath a rearward portion of the ramp. When an inserted male terminal nears the end of its insertion, and engages the rearward portion of the ramp, the ramp is forced downwardly and comes into contact with the cantilevered free end of the secondary spring element to increase the final retention force.

In a fourth embodiment of the invention, the primary spring ramp is slotted down the middle, and the secondary spring element, whether connected to the ramp or to the base, is located below and aligned with the slot or aperture so as to be raised through the slot into engagement with the inserted male terminal as the primary ramp is depressed. In a preferred form, the secondary spring element is connected to a forward portion of the ramp, and is bent downwardly with a V-shape such that its rearward, uppermost end forms a secondary electrical contact to engage the underside of the male terminal through the slot.

Additional features and advantages of the invention will become apparent upon further reading of the specification, in light of the accompanying drawings.

BRIEF DESCRIPTION OF THE DRAWINGS

FIG. 5A is a side elevational view of a female spring contact according to a third embodiment of the present invention;

FIG. 5B is a perspective view of the spring contact of FIG. 5A;

FIGS. 5C and 5D illustrate two stages of male terminal insertion on the spring contact of FIG. 5A;

DETAILED DESCRIPTION OF THE ILLUSTRATED EMBODIMENTS

Figure 1:
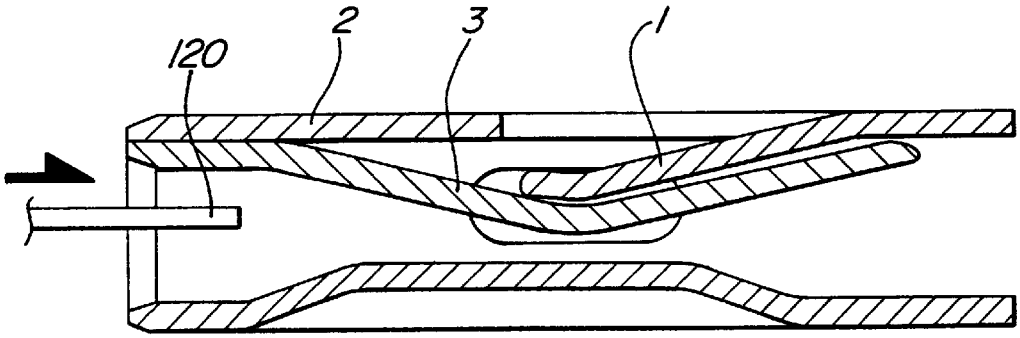
FIG-1 PRIOR ART
FIG. 1 is a side section view of a prior art female terminal.
Figure 2:
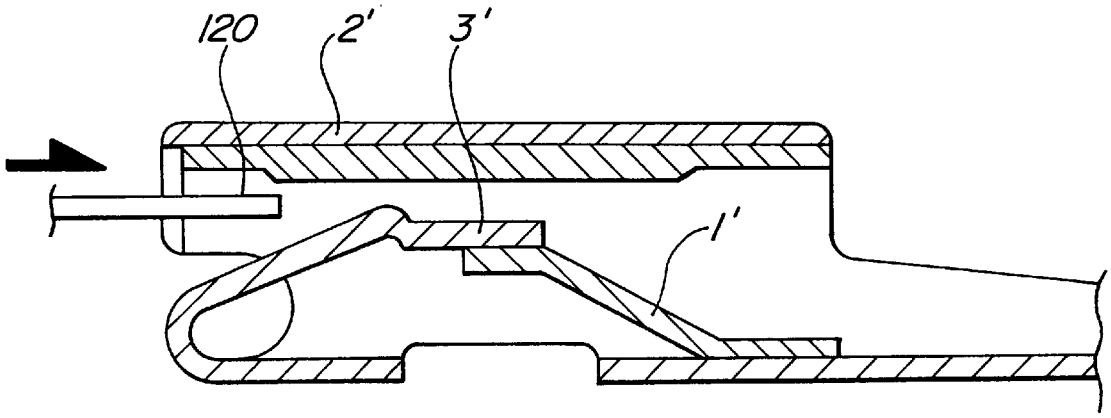
FIG-2 PRIOR ART
FIG. 2 is a side section view of a second prior art female terminal.
Figure 3A:
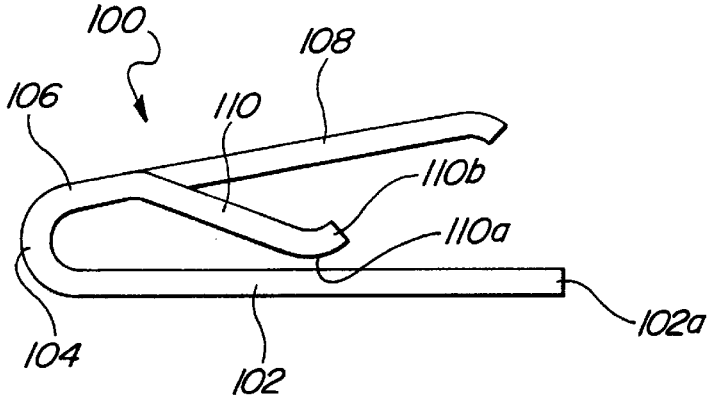
FIG. 3A is a side elevational view of a female spring contact according to a first embodiment of the present invention.
Figure 3B:
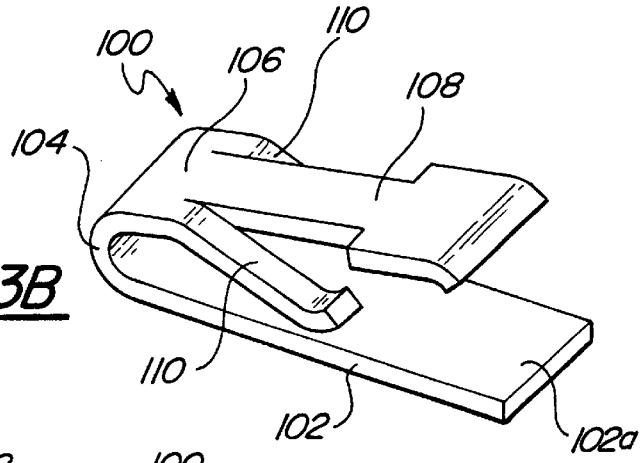
FIG. 3B is a perspective view of the female spring contact of FIG. 3A.

Referring first to FIGS. 3A and 3B, a first embodiment of the invention is generally illustrated at reference numeral 100. Contact 100 is formed from a single piece of conductive metal, for example copper or tin-plated copper. It will be understood by those skilled in the art that while contact 100 as illustrated may be formed as a separate piece, it preferably comprises an integral extension of a complete female terminal having a stem, conductor mating structure such as wire-crimping tabs, and other known structure such as that shown in FIG. 2.

Contact 100 includes a base 102 whose rearward end 102*a* is electrically connected to (and preferably an integral extension of) the remainder of a female terminal in known manner, and whose forward end is defined by a spring radius 104 formed by bending the metal strip material of the terminal to form a spring arm or ramp 106. Spring ramp 106 is set at an acute angle from the horizontal so as to be engaged by a male terminal inserted in the female terminal and to yield under spring tension as the male terminal is inserted. The amount of spring force required to deflect ramp 106 is subject to many variables known to those skilled in the art, including but not limited to the thickness of the metal forming the contact, the radius at bend 104, and the properties of the metal used for the contact.

A ramp formed as a simple flat arm would present an essentially constant insertion force to the male terminal in known manner. Inventive contact 100, however, uses a unique spring ramp 106 formed into a primary middle or inner arm 108 and secondary outer arms 110. Secondary arms 110 can be formed by cutting or stamping cantilevered strips from either side or edge of the spring ramp with their free ends toward the rear of the female contact. Secondary arms 110 are bent downwardly, preferably as illustrated with a lowermost bottom portion 110*a* and a slightly upraised tip 110*b*. The lowermost or bottom portion 110*a* is spaced above base 102 in the at-rest terminal position illustrated in FIGS. 3A and 3B.

Figure 3C:
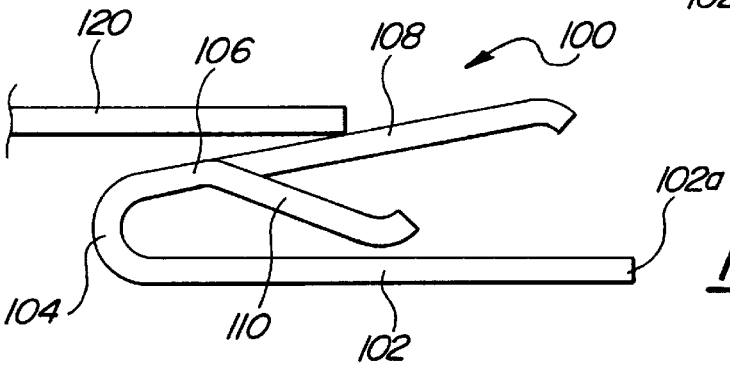
FIGS. 3C and 3D illustrate two stages of male terminal insertion on the spring contact of FIG. 3A.
Figure 3D:
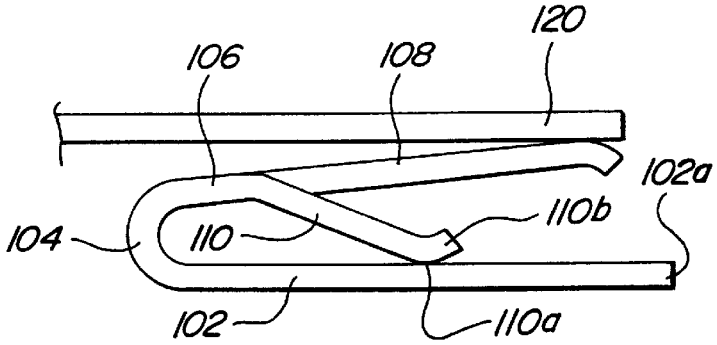

Referring next to FIGS. 3C and 3D, spring contact 100 is shown being deflected by a male terminal 120 as the male terminal is inserted into the female terminal chamber. In FIG. 3C, the male terminal has just begun to engage ramp 106 and in particular, main arm 108 begins deflecting downwardly under spring force. Referring to FIG. 3D, as the male terminal nears or reaches its fully inserted position in the female terminal chamber, the main arm 108 is deflected downwardly sufficiently to place secondary arms 110 in contact with base 102, thereby significantly increasing the spring force acting on male terminal 120. The result is that, while initial insertion force is normal or even slightly reduced, the final retention force acting against male terminal 120 is greater to maintain a secure electrical connection in the female terminal chamber.

It will be understood by those skilled in the art that the point at which secondary spring arms 110 act against base 102 to increase the spring force is a matter of choice depending on the desired insertion characteristics for a particular terminal application. The thickness of the secondary arms, the degree to which they are angled, how far forwardly or rearwardly they are placed and other factors are matters for case-by-case selection by those skilled in the art now that we have disclosed this embodiment of the invention.

Figure 4A:
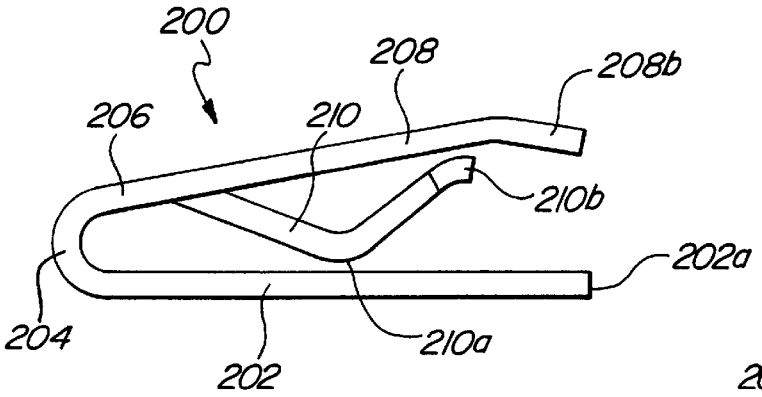
FIG. 4A is a side elevational view of a female spring contact according to a second embodiment of the present invention.
Figure 4B:
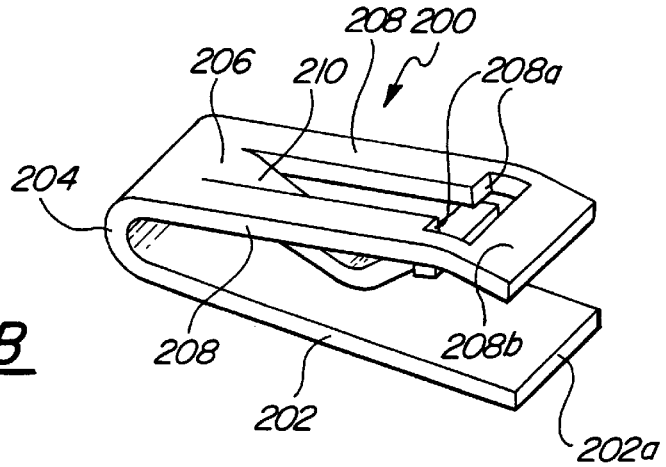
FIG. 4B is a perspective view of the spring contact of FIG. 4A.
Figure 4C:
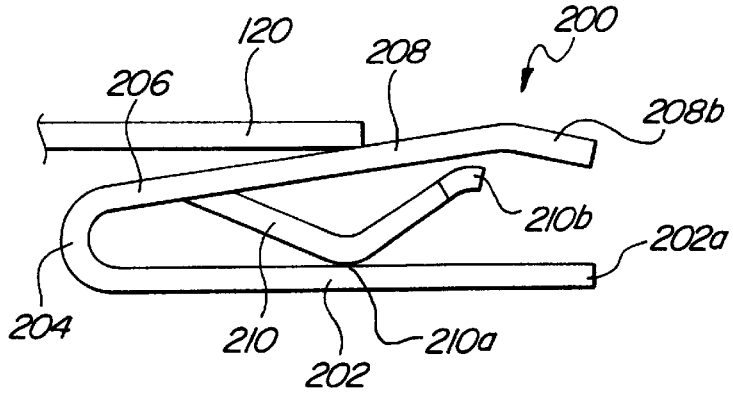
FIGS. 4C and 4D illustrate two stages of male terminal insertion on the spring contact of FIG. 4A.
Figure 4D:
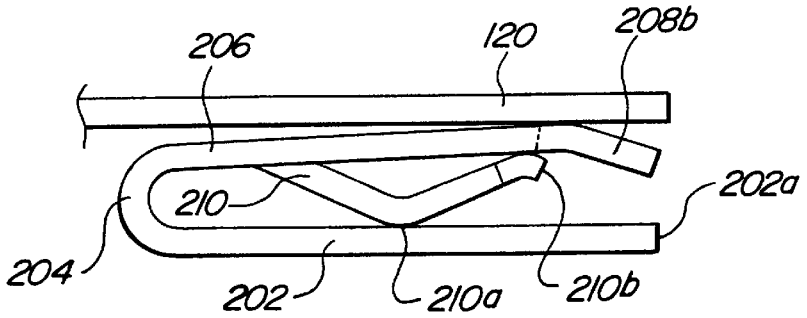

Referring next to FIGS. 4A and 4B, a second embodiment of the invention is illustrated generally as female spring contact 200 formed from a single piece of conductive metal and having a base 202 which is electrically (and preferably integrally) connected to the remainder of a standard female wire harness terminal structure at rearward end 202*a*. The forward end of contact 200 is bent or radiused at 204 to form a cantilevered spring ramp 206 extending rearwardly and upwardly at an acute angle designed to receive a mating male terminal blade in a spring-tensioned electrical connection in the female terminal chamber. Ramp 206 includes primary outer contact arms 208 formed by a slot or aperture cut or stamped between them to create a cantilevered, secondary inner contact arm 210 attached to ramp 206 at a forward portion thereof.

Secondary contact arm 210 is bent, preferably in a V-shape, with a bottom 210*a* located adjacent but spaced from base 202, and an uppermost tip ending in a pad or cross arm 210*b* adjacent but spaced below inner edges 208*a* of primary contact arms 208 on ramp 206. The rearwardmost end of ramp 206 terminates in a tip 208*b*, which in the illustrated embodiment is bent downwardly at an angle below horizontal.

It will be understood that spring contact 200 is in an at-rest condition in FIGS. 4A and 4B, with the illustrated spacing between the secondary contact arm 210 and base 202 and ramp 206.

The most significant differences between the embodiment of FIGS. 4A and 4B and the embodiment of FIGS. 3A and 3B are the interior location of the single secondary contact 210, and its engagement with the underside of ramp 206 as insertion of the mating male terminal progresses. As the spring ramp 206 is flexed downwardly, bottommost portion 210*a* of the secondary contact arm bottoms out against base 202, while at approximately the same time tip 210*b* is engaged by lower surfaces of ramp 206. This results in a sudden increase in the spring force of ramp 206 presented to the insertion of the male terminal blade, and preferably occurs at or near full insertion so that the initial insertion force is unaffected, while the retention force is greatly increased.

As is common to all of the embodiments disclosed herein, the exact point at which the spring force is increased by engagement of the secondary contact is a matter of choice to be implemented by those skilled in the art for a particular terminal application. It will depend on many factors, some listed above, which will be apparent to those skilled in the art. Likewise, it will be understood that the particular illustrated structure in FIGS. 4A–4D for a contact with a secondary, force-increasing arm cut from a middle or interior portion of the spring ramp 206 is not the only possible structure, since variations in the length and shape of the secondary contact, the aperture in the spring ramp, the length of the secondary arm, the shape and angle and location of the bend or bends in the secondary arm, and other features are subject to variation depending on the desired terminal characteristics.

Referring next to FIGS. 5A and 5B, a third embodiment of the invention is illustrated as female spring contact 300.

Whereas the previous two embodiments of FIGS. 3A and 4A provide an essentially normal insertion force with higher finishing/retaining force, contact 300 in FIG. 5A provides both a reduced insertion force and an increased retention force. Contact 300 includes a base 302 which is electrically connected and preferably integrally connected at a rearward end 302*a* with the remainder of a female terminal in standard fashion. The forward end of contact 300 includes a bend or radius 304 from which extends an upper spring ramp 306 extending rearwardly and upwardly at an acute angle, again in generally known fashion. However, to reduce the initial insertion force, a continuous aperture or slot 308 extends from ramp 306 around spring radius 304 and partway along base 302. The secondary spring arm 314 in the embodiment of FIG. 5A is accordingly connected to base 302 rather than to the spring ramp as in the previous embodiments. This provides an independent secondary spring resistance which, when engaged by spring ramp 306, increases the spring force needed to deflect spring ramp 306 and thereby increases the contact or retention force on the male terminal being inserted. For this purpose, the secondary spring arm 314 is located adjacent but spaced from the underside of spring ramp 306 in the terminal at-rest position illustrated in FIGS. 5A and 5B.

Accordingly, referring to FIGS. 5C and 5D, as a mating male terminal is initially inserted against ramp 306 in the female terminal chamber (FIG. 5C), ramp 306 begins to deflect downwardly with a reduced initial force as compared to a ramp whose bend radius is defined by a solid web or wall. As the male terminal is inserted further in the female chamber, and moves rearwardly along ramp 306 to deflect the ramp downwardly, the bottom of ramp 306 contacts secondary spring arm 314, resulting in a sudden increase of spring force useful in signaling the end of insertion and retaining the male terminal in a secure electrical connection.

Again, the particular shape, length, and other aspects of ramp 306, aperture 308, and the secondary spring arm 314 for differing terminal applications are subject to variation as will be understood by those skilled in the art.

Figure 6A:
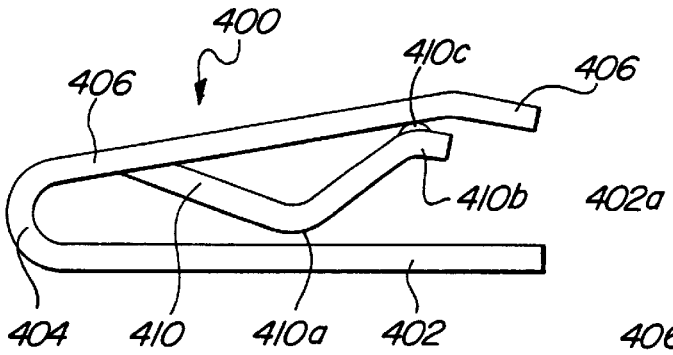
FIG. 6A is a side elevational view of a female spring contact according to a fourth embodiment of the present invention.
Figure 6B:
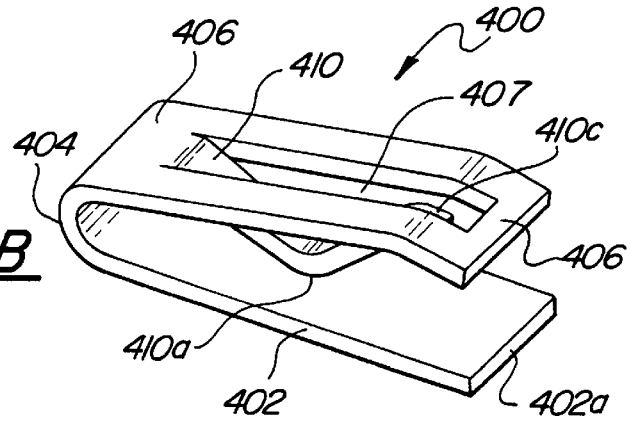
FIG. 6B is a perspective view of the spring contact of FIG. 6A.
Figure 6C:
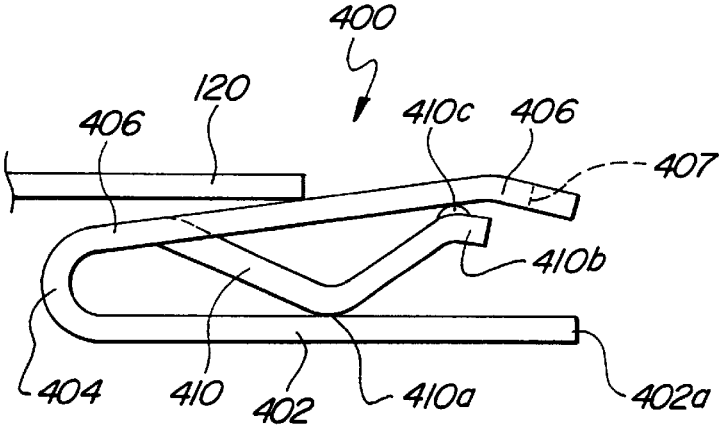
FIGS. 6C and 6D illustrate two stages of male terminal insertion on the spring contact of FIG. 6A.
Figure 6D:
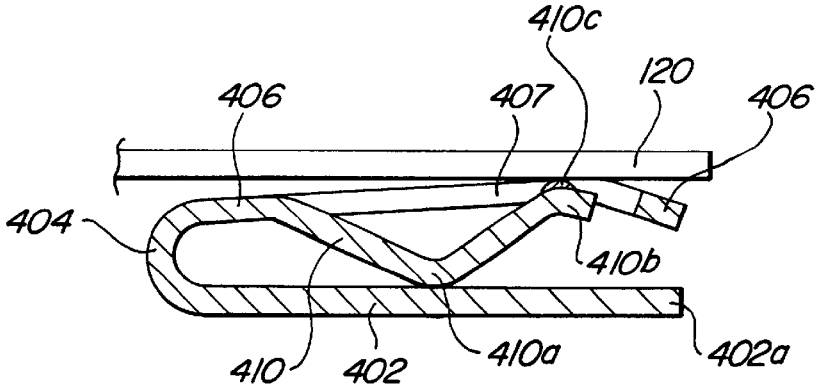

Referring next to FIGS. 6A and 6B, a fourth embodiment of the invention is illustrated generally as female spring contact 400. Like the previous embodiments, contact 400 has a base 402 which at its rearward end 402*a* is electrically (and preferably integrally) connected to the remainder of a female wire harness terminal in known manner. Spring radius 404 connects base 402 to a spring ramp 406 which extends rearwardly and upwardly at an acute angle to form a spring-tensioned contact for an inserted male terminal. Spring ramp 406 has an aperture or slot 407 along at least a portion of its interior, preferably in the middle, with at least part of the material removed to make the slot comprising a cantilevered secondary spring arm 410 connected at one end to a forward portion of spring ramp 406. Secondary spring 410 is generally V-shaped, with the lowermost portion 410*a* adjacent and spaced above base 402, and an upper end or tip 410*b* adjacent and spaced below spring ramp 406, in particular below the ramp's upper surface and located either in or below slot 407. The upper end or tip 410*b* of secondary spring arm 410 includes a secondary electrical contact 410*c*, which as shown in the illustrated embodiment may comprise a rounded bead. Alternately, secondary contact 410*c* could be a specially plated or coated portion of tip 410*b*, for example with a conductivity-enhancing metal film or plating.

Like spring arm 210 in the embodiment of FIGS. 4A–4D, secondary spring arm 410 in FIGS. 6A and 6B offers no increase to the initial insertion force of a male terminal against ramp 406, but at or near full insertion it is deflected downwardly along with ramp 406 into contact with base 402, thereby increasing the spring force of the ramp exerted against the inserted male terminal. Additionally, tip 410*b* and in particular the secondary electrical contact portion 410*c* is aligned with an open portion of slot 407 such that secondary contact 410*c* is brought into electrical contact with the underside of the male terminal at or near the end of male terminal insertion. Accordingly, the embodiment of FIGS. 6A and 6B not only provides an increased retention force at or near the end of the terminal insertion procedure, but additionally provides a supplemental electrical contact point against the underside of the inserted male terminal with little or no sacrificial wear or wiping occurring between them, and in a region of the male terminal which remains generally free of wear due to its alignment with the slot 407.

Like the previous embodiments, the overall shape, size, spacing and location of the spring ramp, the slot 407, and the secondary spring arm and its various bends and contact points can all be adjusted to apply the invention to different terminal applications using ordinary skill in the art.

It will be understood that the foregoing embodiments of the invention are depicted for purposes of illustration only, and are currently preferred embodiments, and are not intended to limit the invention beyond the scope of the appended claims. Many variations and modifications can be made to the illustrated embodiments without departing from the scope of the invention.

Accordingly, I claim:

1. In a chamber of a female wire harness terminal, a female spring contact comprising:

a base electrically connected to the terminal;

a cantilevered spring ramp connected to the base by a spring radius and extending rearwardly and upwardly from a terminal insertion end of the chamber at an acute angle above the base, the spring ramp having an insertion force at a first lower level over an initial range of insertion of a mating terminal into the chamber; and a secondary spring arm, the secondary spring arm located between a forward end of the female spring contact and a rearward end of the spring ramp between the spring ramp and the base, the secondary spring arm further having a first end attached to one of the spring ramp and the base and a free end located between the spring ramp and the base, the free end comprising material removed from the spring ramp, the secondary spring arm being responsive to deflection of the spring ramp by the mating terminal beyond the initial range of insertion to increase the insertion force to a second greater level.

2. The female spring contact of claim 1, wherein the first end of the secondary spring arm is formed from a portion of the base located under the spring ramp.

3. In a chamber of a female wire harness terminal, a female spring contact comprising:

a base electrically connected to the terminal;

a spring ramp connected to the base by a spring radius and extending rearwardly and upwardly from a terminal insertion end of the chamber at an acute angle above the base, the spring ramp having an insertion force at a first lower level over an initial range of insertion of a mating terminal into the chamber; and a secondary spring arm on the female spring contact, the secondary spring arm located between a forward end of the female spring contact and a rearward end of the spring ramp, the secondary spring arm being responsive to deflection of the spring ramp by the mating terminal beyond the initial range of insertion to increase the insertion force to a second greater level, wherein the secondary spring arm is an outer arm located to one side of and below the spring ramp.

4. The female spring contact of claim 3, wherein the secondary spring arm comprises two outer arms.

5. The female spring contact of claim 4, wherein the outer arms are formed by cantilevered edge portions of the spring ramp bent downwardly toward the base.

6. In a chamber of a female wire harness terminal, a female spring contact comprising:

a base electrically connected to the terminal;

a spring ramp connected to the base by a spring radius and extending rearwardly and upwardly from a terminal insertion end of the chamber at an acute angle above the base, the spring ramp having an insertion force at a first lower level over an initial range of insertion of a mating terminal into the chamber; and a secondary spring arm on the female spring contact, the secondary spring arm located between a forward end of the female spring contact and a rearward end of the spring ramp, the secondary spring arm being responsive to deflection of the spring ramp by the mating terminal beyond the initial range of insertion to increase the insertion force to a second greater level, wherein the secondary spring arm comprises a cantilevered interior portion of the spring ramp bent downwardly toward the base.

7. The female spring contact of claim 5, wherein the secondary spring arm has a lower portion adapted to engage the base upon deflection of the spring ramp by the mating terminal beyond the initial range of insertion, and an upper portion adapted to engage the spring ramp when the spring ramp is further deflected and the lower portion engages the base.

8. The female spring contact of claim 6, wherein the secondary spring arm includes a bottom portion adapted to engage the base upon deflection of the spring ramp by the mating terminal beyond the initial range of insertion, and an upper portion aligned with an aperture in the spring ramp and adapted to extend through the aperture to engage a mating terminal when the spring ramp is further deflected and the bottom portion engages the base.

9. In a chamber of a female wire harness terminal, a female spring contact comprising:

a base electrically connected to the terminal;

a spring ramp connected to the base by a spring radius and extending rearwardly and upwardly from a terminal insertion end of the chamber at an acute angle above the base, the spring ramp having an insertion force at a first lower level over an initial range of insertion of a mating terminal into the chamber; and a secondary spring arm on the female spring contact, the secondary spring arm located between a forward end of the female spring contact and a rearward end of the spring ramp, the secondary spring arm being responsive to deflection of the spring ramp by the mating terminal beyond the initial range of insertion to increase the insertion force to a second greater level, wherein the secondary spring arm is formed from a cantilevered portion of the base located under the spring ramp, and wherein the secondary spring arm comprises a strip removed from a portion of the spring ramp, the spring radius, and the base.

10. A female spring contact adapted for use in a female wire harness terminal, the contact comprising:

a base for electrical connection to the terminal;

a deflectable spring ramp adapted to be deflected downwardly toward the base under an initial insertion force by an inserted male terminal;

a secondary spring arm formed on the contact and located below the spring ramp to be responsive to a final stage of spring ramp deflection corresponding to the completion or near-completion of male terminal insertion to increase the final spring force exerted by the spring ramp on the inserted terminal, the secondary spring arm having a free end formed from a cantilevered portion of material removed from the spring ramp.

* * * * *